US010598177B2

(12) United States Patent
Nieuwenhuis

(10) Patent No.: US 10,598,177 B2
(45) Date of Patent: Mar. 24, 2020

(54) PUMP UNIT WITH INTEGRATED PISTON PUMP AND ELECTRIC MOTOR

(71) Applicant: Actuant Corporation, Menomonee Falls, WI (US)

(72) Inventor: Marcel Gerardus Maria Nieuwenhuis, Enschede (NL)

(73) Assignee: Power Packer North America, Inc., Westfield, WI (US)

( * ) Notice: Subject to any disclaimer, the term of this patent is extended or adjusted under 35 U.S.C. 154(b) by 0 days.

(21) Appl. No.: 16/099,142

(22) PCT Filed: May 2, 2017

(86) PCT No.: PCT/NL2017/050279
§ 371 (c)(1),
(2) Date: Nov. 5, 2018

(87) PCT Pub. No.: WO2017/192036
PCT Pub. Date: Nov. 9, 2017

(65) Prior Publication Data

US 2019/0154036 A1 May 23, 2019

(30) Foreign Application Priority Data

May 3, 2016 (NL) ..... 2016728

(51) Int. Cl.
*F04B 1/107* (2006.01)
*F04C 2/344* (2006.01)
(Continued)

(52) U.S. Cl.
CPC ..... *F04C 2/3441* (2013.01); *F04B 1/0456* (2013.01); *F04B 1/1071* (2013.01);
(Continued)

(58) Field of Classification Search
USPC ..... 417/271, 415, 410.3, 410.4
See application file for complete search history.

(56) References Cited

U.S. PATENT DOCUMENTS 4,555,223 A * 11/1985 Budecker ..... F01B 1/0644 417/462
4,930,994 A * 6/1990 Budecker ..... B60T 8/4031 417/286
(Continued)

FOREIGN PATENT DOCUMENTS

EP 0217128 4/1987
EP 0544856 8/1996
(Continued)

OTHER PUBLICATIONS

Netherlands Search Report and Written Opinion for Application No. NL2016728 dated Dec. 30, 2016 (12 pages).
(Continued)

*Primary Examiner* — Charles G Freay
*Assistant Examiner* — Thomas Fink
(74) *Attorney, Agent, or Firm* — Michael Best & Friedrich LLP

(57) ABSTRACT

An automotive hydraulic actuating system for actuating a movable vehicle part, like a roof part or a wheel suspension. The actuating system comprises a pump unit. The pump unit comprises a piston pump which has a pump rotor and an electric motor which has a motor rotor. The pump rotor and motor rotor are incorporated into a single common rotor. The rotor is a one piece item. The rotor is positioned inside a pump chamber around a pump stator of the piston pump. The pump stator provides a full support to the common rotor. Advantageously, without a separate motor stator, the pump unit has a more compact configuration. Additionally, the pump unit has an improved dynamic performance which
(Continued)

contributes to a silent and reliable operation at a high rotational speed.

11 Claims, 3 Drawing Sheets

(51) Int. Cl.

| | |
|---|---|
| ***F04B 1/0456*** | (2020.01) |
| ***F04B 1/1071*** | (2020.01) |
| ***F04B 17/03*** | (2006.01) |
| ***F04C 14/10*** | (2006.01) |
| ***F04C 14/22*** | (2006.01) |
| ***F04C 14/24*** | (2006.01) |
| *F04C 15/00* | (2006.01) |

(52) U.S. Cl.
CPC ..... *F04B 17/03* (2013.01); *F04C 14/10* (2013.01); *F04C 14/226* (2013.01); *F04C 14/24* (2013.01); *F04C 15/0034* (2013.01)

(56) References Cited

U.S. PATENT DOCUMENTS 5,067,768 A * 11/1991 Fischbach ..... B60J 7/1273 296/107.08
5,190,447 A * 3/1993 Schneider ..... F04B 1/047 417/270
5,360,322 A * 11/1994 Henein ..... B60G 17/0152 417/313
6,168,393 B1 1/2001 Huber et al.
2008/0118384 A1* 5/2008 Nishikata ..... F01C 21/0809 418/111
2008/0219873 A1* 9/2008 Nishikata ..... F01C 21/0809 418/77
2008/0219875 A1* 9/2008 Nishikata ..... F04C 2/3442 418/104
2014/0363319 A1 12/2014 Carboneri
2015/0033938 A1* 2/2015 Erlston ..... F01B 21/04 91/55
2015/0147210 A1* 5/2015 Navarro ..... F04B 1/047 417/533
2015/0197130 A1* 7/2015 Smith ..... B60G 11/46 280/124.175

FOREIGN PATENT DOCUMENTS

| | | |
|---|---|---|
| EP | 1598558 | 11/2005 |
| EP | 2160965 | 3/2010 |
| GB | 812812 | 4/1959 |

OTHER PUBLICATIONS

International Search Report and Written Opinion for Application No. PCT/NL2017/050279 dated Aug. 23, 2017 (14 pages).
International Preliminary Report on Patentability for Application No. PCT/NL2017/050279 dated Sep. 28, 2018 (16 pages).
Office Action issued from The Chinese Patent Office for related Application No. 201780038410.7 dated May 31, 2019 (4 pages including Statement of Relevance).

* cited by examiner

PUMP UNIT WITH INTEGRATED PISTON PUMP AND ELECTRIC MOTOR

CROSS-REFERENCE TO RELATED APPLICATIONS

This application is a national stage entry under 35 U.S.C. § 371 of co-pending International Patent Application No. PCT/NL/2017050279 filed on May 2, 2017, the entire content of which is incorporated herein by reference.

FIELD

The present invention relates to a pump unit for pressurising a hydraulic actuating system, and more particularly to a pump unit for an automotive appliance for actuating a convertible roof system or a vehicle wheel suspension.

BACKGROUND

The present invention relates to a pump unit for pressurising a hydraulic actuating system, in particular for an automotive appliance, more in particular for actuating a convertible roof system or a vehicle wheel suspension. The pump unit comprises a pump housing including a pump chamber for housing a piston pump. The piston pump comprises a pump stator which is stationarily positioned inside the pump chamber. The pump stator has a longitudinal pump stator body which defines an axial axis of the pump unit. The pump stator body includes at least two channels which respectively serve as an inlet or outlet channel. The piston pump further comprises a pump rotor. The pump rotor is positioned around the pump stator. The pump rotor has a pump rotor body which is driveable in a rotational direction about the axial axis. The pump rotor body includes several cylinder holes for receiving pistons. The pistons are radially slidable with respect to the pump rotor body.

Further, the piston pump comprises an eccentric ring for determining a pump capacity. The eccentric ring is positioned around the pump rotor body. The eccentric ring is eccentrically positioned with respect to the pump rotor body to provide an eccentricity in between an outer circumference rotor surface of the pump rotor body and an inner running surface of the eccentric ring.

U.S. Pat. No. 6,168,393 in the name of Hoerbiger discloses a conventional motor-driven radial piston pump assembly. The pump assembly is configured for transportable purposes or for generating small forces, for example, for the hydraulic activation of motor vehicle folding canopy tops. The main requirement to this pump assembly is that the assembly is as small as possible, such that the pump assembly can be built into narrow mounting spaces, e.g. into a narrow chassis compartment of a vehicle.

The pump assembly includes a radial piston pump which is supported by a base section on one side thereof. The base section serves to mount the pump together with all its connection lines, a control element and an electric motor. The electric motor is operatively connected to the pump and is supported on the base section coaxially with respect to a central axis of a motor output shaft which lies along a pump propulsion axis.

The electric motor is typically a conventional DC motor which functions to operate the pump. The electric motor comprises a motor housing which can be closed by a cover. The motor housing houses the motor. The motor is supported at a pump end and an opposite end. The motor has an output motor shaft at its pump end. Electrical components are provided at the opposite end. The output motor shaft is connected by a coupling to a rotor of the pump. The coupling comprises a flange shaped body and a beam shaped the link.

The electric motor is connected to the base section by the motor housing, so that all supporting, bearing forces and moments are carried by the base section. The base section can be constructed for the attachment of the entire motor-driven radial piston pump assembly. The base section bears the reaction forces and the weight of the motor and transmits those forces directly on the base section which also supports the pump which effects in a compact construction.

A drawback to this known pump assembly is that its outer size is still not small enough. A pump assembly of this type having small outer dimensions is highly desired.

GB 812.812A discloses a pump which comprises a housing for a stator, a rotor with pistons and a movable track ring. The rotor and track ring are arranged in a cylindrical recess of the housing. The rotor has a rotor shaft which is received in bores which are provided with anti-friction bearings, for example of the needle roller type on which the rotor shaft revolves. At its outer end, the rotor shaft is further supported by an additional anti-friction bearing. The rotor can be driven by coupling a motor onto the outer end of the motor shaft.

A drawback of this pump is that the pump capacity is limited. Further, the pump requires too much build-in space for use in an automotive actuating system.

EP 0 544.856 discloses a pump unit including a hydraulic piston pump driven by an electric motor. The piston pump and electric motor are housed in a common cylindrical pump housing which is at both ends closed by lid shaped components. The electric motor and piston pump form a first and second module which are coupled to each other.

The electric motor comprises a motor rotor. The motor rotor supports several magnets at its outer circumference. At one side, the motor rotor is journaled by a ball bearing to a shaft and at an opposite side, the motor rotor is supported by the piston pump. The motor rotor is driveable by actuating radially positioned coils opposite the magnets. The motor rotor is rotationally connected to a pump rotor of the piston pump, such that the pump rotor rotates together with the motor rotor.

The piston pump has a pump rotor body which is supported by a pump stator. The pump stator has an elongated stator body which is at one end fixed to the pump housing. The pump rotor body has a protrusion which is received in a recess of the motor rotor body. The pump rotor body is rotationally fixed to the motor rotor.

A drawback of the disclosed pump unit is that its outer size is still not small enough. A more compact pump unit is desired.

A further drawback is that the disclosed pump unit has a poor dynamic performance. Particularly, when driving such a pump unit at a high rotational speed and in an arbitrary orientation as it is desired in automotive appliances, such a pump unit will become unstable.

The general object of the present invention is to at least partially eliminate the above mentioned drawbacks and/or to provide a useable alternative. More specifically, it is an object of the invention to provide a pump unit which has a compact configuration and additionally provides stable dynamic behaviour when operating at a high rotational speed as it is required in automotive appliances, like operating a convertible roof system.

More in particular, the invention aims to provide a hydraulic actuating system including a compact pump unit which can be built-in into narrow mounting spaces, like a chassis compartment of a vehicle. Additionally, it is a further object to provide a pump unit which has a high dynamic performance which allows a build-in of the pump unit in an arbitrary orientation.

According to a first aspect of the invention, this object is achieved by a pump unit according to claim 1.

SUMMARY

According to the invention, a pump unit is provided for pressurising a hydraulic actuating system, in particular for actuating a convertible roof system. The pump unit comprises a pump housing including a pump chamber for housing a piston pump. The pump unit further comprises an electric motor for driving the piston pump.

The electric motor comprises a motor rotor which has a longitudinal motor rotor body including several magnets. The motor rotor body defines an axial axis. The magnets are positioned at an outer surface of the motor rotor body. Further, the electric motor comprises a field coil which is positioned opposite the magnets of the motor rotor body for rotationally driving the motor rotor body.

The piston pump comprises a pump stator which is stationarily positioned inside the pump chamber. The pump stator has a longitudinal pump stator body which includes at least two channels respectively serving as an inlet or outlet channel. Further, the piston pump comprises a pump rotor which is positioned around the pump stator body. The pump rotor has a pump rotor body which is driveable in a rotational direction about the axial axis. The pump rotor body includes several cylinder holes for each receiving a piston which is slidable with respect to the pump rotor body in a radial direction. Further, the piston pump comprises an eccentric ring which is positioned around the pump rotor body. The eccentric ring is eccentrically positioned at an eccentricity with respect to the pump rotor body to provide a pump capacity.

According to the first aspect of the invention an improvement is provided in that the motor rotor and the pump rotor are incorporated into a common rotor. The common rotor is a one piece item. The common rotor is positioned inside the pump chamber. The pump chamber houses the common rotor. The common rotor includes a motor and a pump rotor portion. Functionally seen, the common rotor serves both as a rotor for the electric motor and as a rotor for the piston pump. The improvement according to the first aspect provides that the common rotor is fully supported by the pump stator.

The pump unit according to the first aspect of the invention lacks a motor stator. No separate motor stator is provided to support the motor rotor. According to the first aspect, the motor rotor is incorporated with the pump rotor into a common rotor which is supported by the pump stator only. A separate motor stator is redundant, since the common rotor is fully supported by the pump stator.

In other words, it can also be said that according to the first aspect, the motor stator is incorporated into the pump stator which has resulted in a common stator. Advantageously, the pump unit according to the first aspect may have a compact configuration. Additionally, the pump unit may have a stable dynamic performance which allows high rotational speeds and an installation of the pump unit in an arbitrary orientation.

In comparison with the prior art pump unit from EP 0.544.856, the pump unit according to the first aspect of the invention is supported by the pump stator only and not by a separate second shaft, a motor stator, positioned at an opposite side of the common rotor. According to the first aspect only one component, the pump stator, is provided to support the common rotor. Advantageously, a possible misalignment in between separate components is prevented which contributes to an improved dynamic performance of the pump unit according to the invention. Potential unbalances are minimised which allows a high rotational speed of the common rotor to achieve a relatively high pump capacity by a relatively small sized pump unit.

In an embodiment of the pump unit according to the invention, the pump stator is fixed to the pump housing as a cantilever. The pump stator has a proximal end which is fixed to the pump housing and a free distal end. The pump stator is connected at only one end to the pump housing. Herewith, instead of a support at both sides of the common rotor, the common rotor is supported at only one side to the pump housing, i.e. the proximal end of the pump stator. Advantageously, by providing a single sided support to the common rotor, the pump unit may have a further compact configuration in the axial direction.

In an embodiment of the pump unit according to the invention, the pump stator extends through the common rotor over at least a half length of the common rotor. The common rotor has a length in the axial direction which is at most twice a length of the pump stator. Advantageously, the length of the pump stator contributes to a stable dynamic performance. Especially at high speeds it provides a rigid support to the common rotor to counter occurring forces in operation.

In an embodiment of the pump unit according to the invention, the common rotor is a one piece item which is manufactured by a lathe operation from a solid part. The solid part may be a piece of rough rod material out of a single kind of material which is subsequently processed by a turning operation to obtain the one piece common rotor. Alternatively, the solid part may be provided by a moulding operation. The solid part may be a one piece pre-fabricated rod material. The solid part may be a so-called hybrid piece, including a combined first and second material, e.g. aluminium and steel, wherein—seen in a longitudinal direction—the first material is positioned adjacent to the second material. The common rotor made from a hybrid material includes the first material which forms the motor rotor portion which is different from the second material which forms the pump rotor portion. Starting with the hybrid piece as an input material, the one piece common rotor may be obtained after carrying out a turning operation. The common rotor formed out of the hybrid piece may comprise a motor rotor portion out of the first material, e.g. aluminium or plastic and a pump rotor portion out of the second material, e.g. steel. Advantageously, forming the common rotor out of a solid part by a turning operation may contribute to an accurately balanced common rotor which contributes to a stable dynamic behaviour.

The prior art pump unit from EP 0.544.856 discloses a common rotor as a one piece item which is manufactured by assembling two pre-manufactured parts. The two parts are welded together. In the embodiment according to the invention, the pump unit has a common rotor as a one piece item manufactured from a single solid part. Instead of an assembly of two separate pre-manufactured parts, the manufacturing out of a single solid part may provide an improved dynamic performance. The manufacturing of the common rotor by a turning operation may minimise any weight unbalances about a central axis of the common rotor. Minimising unbalances contributes advantageously to a more stable dynamic behaviour of the common rotor at a high rotational speed. A swivelling may be reduced. Additionally, minimising unbalances contributes to a more silent operation. Herewith, the described pump unit is in particular suitable to be applied in an automotive hydraulic actuating system. For example, in a highly dynamic controlled vehicle wheel suspension, the pump unit is advantageous, because of its stable dynamic behaviour at high rotational speeds. For example, in a convertible roof system, the described pump unit is advantageous, because of its silent operation.

In an embodiment of the pump unit according to the invention, the motor rotor contains magnets which are positioned at an outer circumferential motor rotor surface of the common rotor. Field coils to generate a magnetic field are positioned opposite the magnets. The field coils are radially spaced from the magnets. Preferably, the field coils are positioned inside the pump chamber of the pump housing. The field coils may be connected to an inner circumferential surface of the pump chamber.

In an embodiment of the pump unit according to the invention, the common rotor comprises a motor rotor recess which is open at a motor rotor end face. The motor rotor recess is adapted to receive the field coils of the electric motor. The motor rotor recess has an inner circumferential surface and an inner bottom surface, wherein the magnets of the motor rotor are positioned at the inner circumferential or bottom surface. Preferably, the magnets are positioned at the inner circumferential surface and the field coils are positioned inside the motor rotor recess at a position which is inwardly radially spaced from the magnets. The field coils are arranged to generate a fluctuating magnetic field in a radial direction to actuate the magnets to drive the motor rotor in a rotational direction.

In an embodiment of the pump unit according to the invention, the magnets of the motor rotor are positioned at the motor rotor end face of the common rotor. The field coils are positioned in an axial direction opposite the magnets of the motor rotor. Preferably, the field coils are positioned outside the pump chamber. The pump chamber may be closed by a closure, wherein the field coils are connected to the closure. Advantageously, the axial arrangement of the magnets and field coils may further contribute to a compact configuration of the common rotor. In comparison with a radial arrangement of the magnets and field coils, a total weight of the common rotor may be reduced and the common rotor may have an increased balance which may contribute to an improved dynamic performance.

In an embodiment of the pump unit according to the invention, the pump unit further comprises a control unit for controlling the pump capacity. The pump capacity may be controlled by controlling a rotational speed of the electric motor. However, preferably, in operation the common rotor is driven at a constant rotational speed and the pump capacity is controlled by adjusting an eccentricity of the eccentric ring of the piston pump. Preferably, the pump housing of the pump unit comprises a closure for closing of the pump chamber. In particular, the closure is a lid including a seal which is mountable to an opening of the pump chamber for sealing the pump chamber. The control unit is mountable to the pump unit.

According to a second aspect of the invention, the control unit is connectable to the closure, wherein the control unit forms a sub-assembly together with the closure. The sub-assembly of the control unit and closure form a module which is mountable to the pump housing. In a further embodiment, the module may comprise the field coils of the electric motor. Preferably, the field coils are positioned in between the closure and the control unit. The field coils are connected at a front side of the closure. The closure comprises a non-ferritic material to conduct a generated magnetic field to the magnets on the motor rotor provided at a back side of the closure. Advantageously, the pump unit has a modular structure which allows a reduction of an assembly time in producing the pump unit.

According to a third aspect of the invention, the reservoir of the pump unit is formed by the pump chamber in the pump housing. The pump stator of the piston pump has an inlet channel which is in fluid communication with the pump chamber. In comparison with a conventional configuration including a separate tank as a reservoir positioned at and outside of the pump housing, the reservoir formed by the pump chamber makes a seal positioned in between the tank and the pump chamber redundant. Advantageously, a risk on leakages which is especially present at high pressures of more than 100 bars is minimised.

Further, the invention relates to a hydraulic actuating system comprising a pump unit according to the invention. Advantageously, the hydraulic actuating system is suitable to be built-in into narrow spaces, like frame compartments. Additionally, the compact configuration of the integrated pump-motor pump unit allows the hydraulic actuating system to be installed invisible from the outside behind movable components, e.g. in medical devices behind furniture parts like hospital beds within a narrow chassis compartment of a vehicle.

The hydraulic actuating system is in particular an automotive hydraulic actuating system comprising a pump unit according to the invention. Advantageously, the pump unit includes a rotary piston pump which is suitable to operate silently and reliably at a high rotational speed. The pump unit is in particular an automotive pump unit configured for operating vehicle parts, like a convertible roof, sunroof, boot lid, hood lid, spoiler or vehicle wheel suspension linkage. Advantageously, the automotive pump unit has a compact configuration which allows an installation of the pump unit in a narrow vehicle compartment, like a chassis compartment which is positioned close to the movable vehicle part.

In an embodiment of the automotive actuating system, the automotive actuating system is a convertible roof system which comprises a convertible roof including a roof part which is movable with respect to a remaining roof part. The convertible roof to be operated serves to selectively cover or open a passenger space of a vehicle and may include several roof parts which are pivotally connected to each other. A first roof part is movable with respect to a second roof part to bring the convertible roof to respectively a closed or open state.

Further, the invention relates to a vehicle comprising such an automotive hydraulic actuating system, like a convertible roof system or vehicle wheel suspension.

Further embodiments are defined in the dependent claims.

BRIEF DESCRIPTION OF THE DRAWINGS

The invention will be explained in more detail with reference to the appended drawings. The drawings show a practical embodiment according to the invention, which may not be interpreted as limiting the scope of the invention. Specific features may also be considered apart from the shown embodiment and may be taken into account in a broader context as a delimiting feature, not only for the shown embodiment but as a common feature for all embodiments falling within the scope of the appended claims, in which:

In the figures, the same reference numbers are used to indicate identical or similar components.

DETAILED DESCRIPTION

Figure 1:
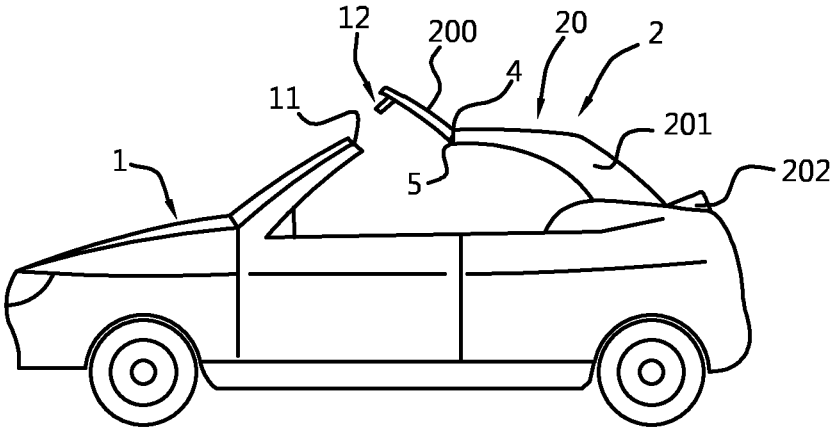
FIG. 1 shows a schematic side view of a vehicle provided with a convertible roof system.

FIG. 1 discloses in a schematic view of a vehicle 1. The vehicle 1 comprises an automotive actuating system for hydraulically actuating movable vehicle parts, like a sunroof, hood lid, boot lid, spoiler, convertible roof or a wheel suspension. As illustrated here, the vehicle 1 is provided with a convertible roof system 2 for selectively opening or covering a passenger space. The convertible roof system 2 has a well known mechanical structure.

Here, the convertible roof system 2 has a convertible roof 20 which includes a front roof part 200. The roof part 200 is pivotally connected about a pivot axis to a remaining roof part 201 of the convertible roof 20. Here, the front roof part 200 is shown in released from a front window frame 11. In a closed configuration of the convertible roof, the front roof part 200 is connected to the front window frame 11 and locked by a locking member 12.

Figure 2:
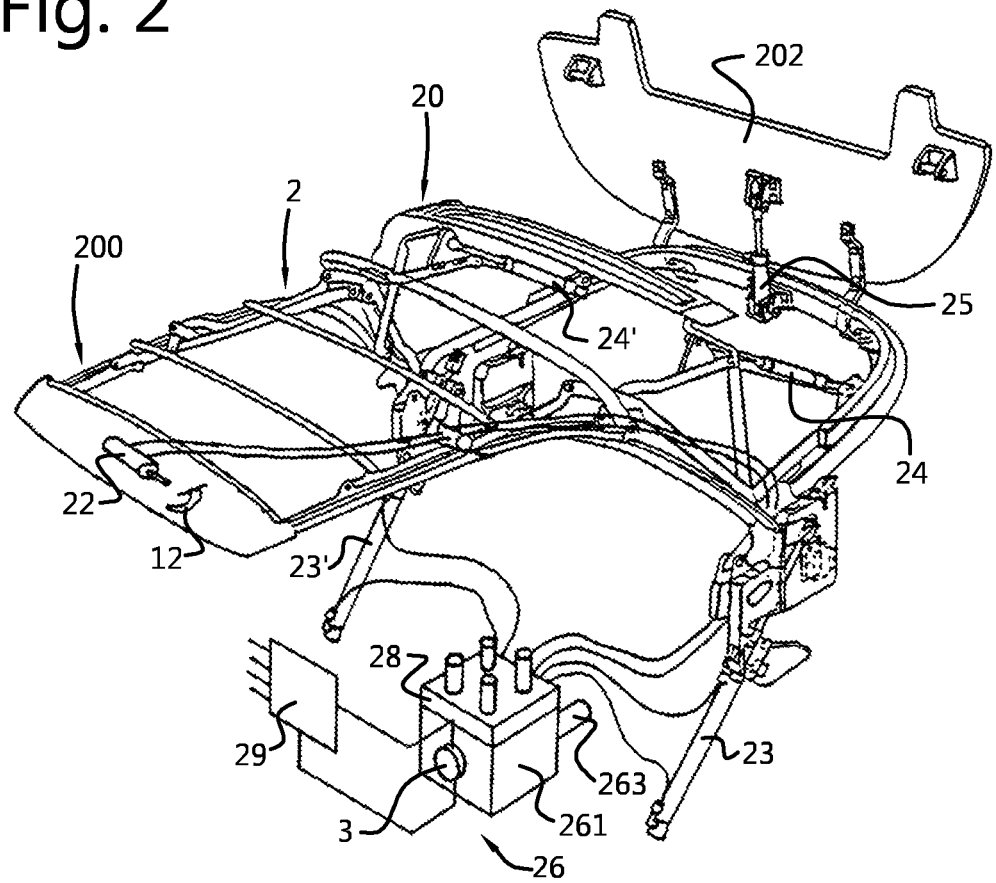
FIG. 2 shows a schematic view of the convertible roof system of a FIG. 1 comprising a hydraulic actuating system which includes a pump unit for pressurising several cylinders.

FIG. 2 shows an embodiment of the convertible roof system 2 in further detail. The general mechanical structure of such a convertible roof system is well known in the art. FIG. 2 further shows a hydraulic actuating system 21. The hydraulic actuating system 21 is arranged to actuate the convertible roof 20, locking member 12 and additionally a cover plate 202. The cover plate 202 is provided to cover a compartment of the vehicle 1 which compartment is configured to receive the convertible roof 20 when transformed into an open configuration.

The hydraulic actuating system 21 comprises two pairs of hydraulic cylinders 23, 23'; 24, 24' for moving the roof parts 200, 201 of the convertible roof 2. A hydraulic cylinder 25 is provided to move the cover plate 202 and a hydraulic cylinder 22 is provided to actuate the locking member 12. The cylinders 22; 23, 23'; 24, 24'; 25 are hydraulically connected by hydraulic conduits to a hydraulic pump unit 26.

The pump unit 26 has a pump housing 261. The pump housing 261 is block shaped. A control unit 29 is provided to control the pump unit 26. The control unit 29 is electrically connected to an electric motor 3 for driving and internally positioned piston pump 4. The electric motor 3 is connected to a front side of the pump housing 261. The piston pump 4 is internally arranged inside the pump housing in a pump chamber 264. The pump chamber 264 is an inner space which is configured for housing the piston pump 4. The arrangement of the piston pump 4 in the pump chamber 264 is further illustrated by FIGS. 3-5 which show a sectional view of the pump unit 26 about a longitudinal axis.

As shown in FIG. 2, the pump unit 26 comprises a valve unit 28. The valve unit is mounted to a mounting face which is here positioned at a top side of the pump housing. Further, the pump unit 26 comprises a reservoir 263 for accumulating hydraulic liquid. The reservoir 263 is here positioned at a backside of the pump housing 261.

Figure 3:
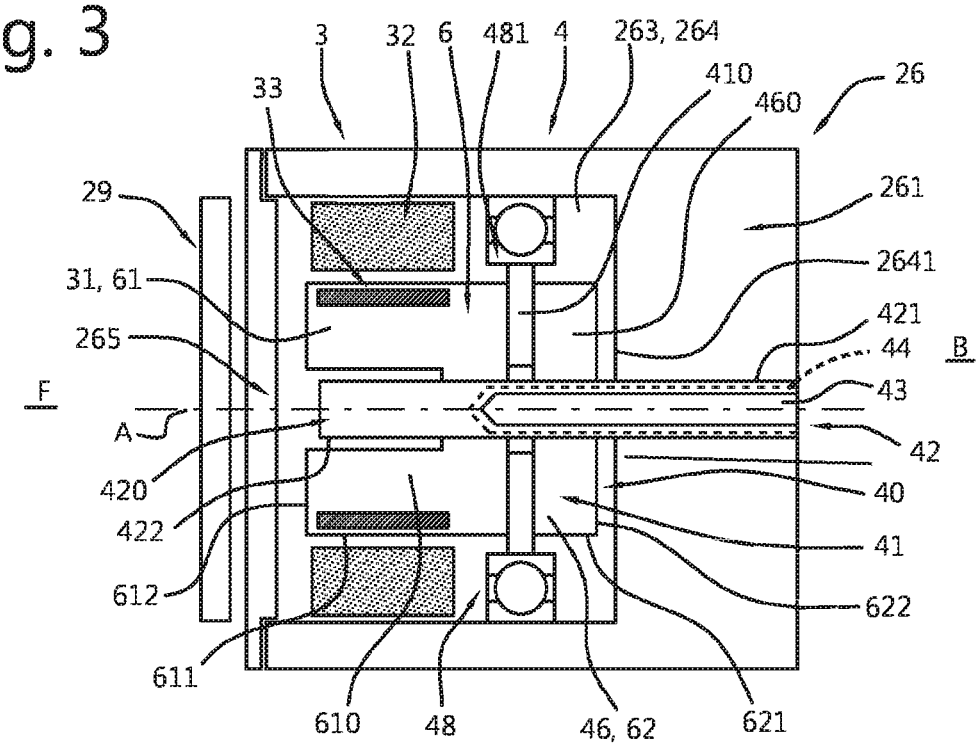
FIG. 3 shows a first embodiment of a pump unit in a schematic sectional view about an axial axis, wherein the pump unit comprises an electric motor and a piston pump which are both received in a pump chamber of a pump housing and wherein the electric motor includes radially arranged magnets and field coils, wherein the field coils are outwardly positioned with respect to magnets.
Figure 4:
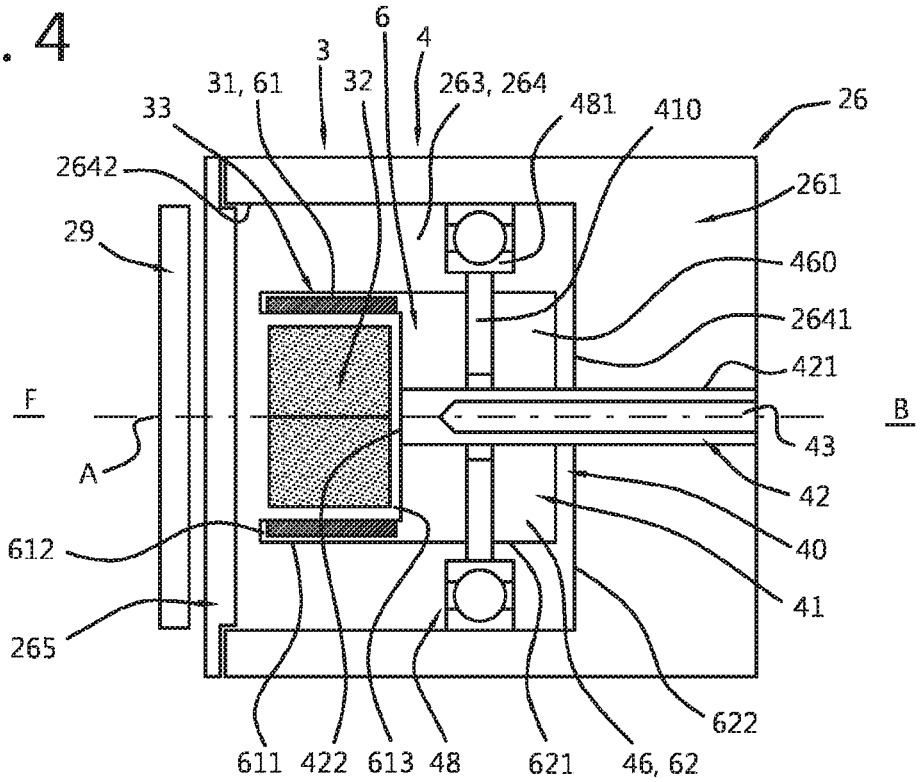
FIG. 4 shows a second embodiment of a pump unit as in FIG. 3, wherein the field coils are inwardly positioned with respect to the magnets.
Figure 5:
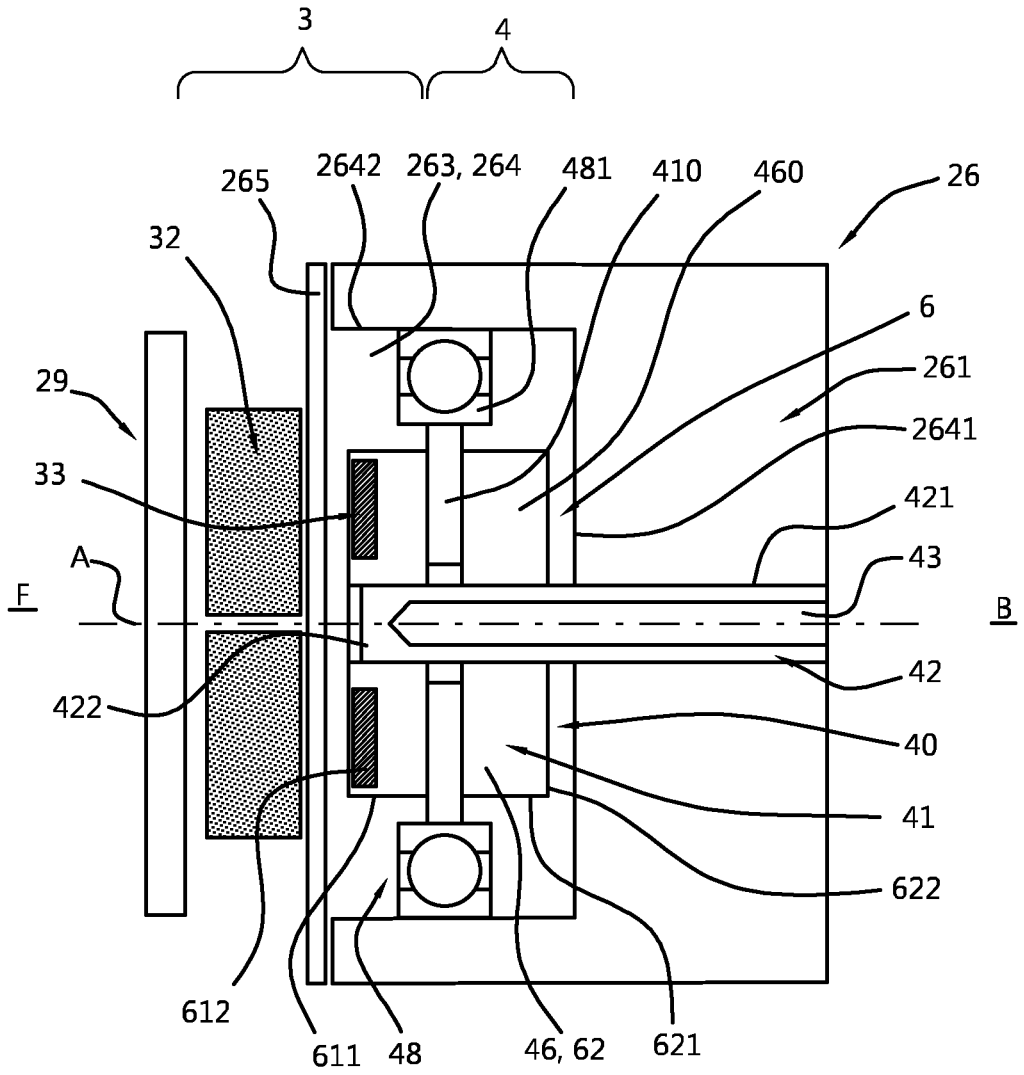
FIG. 5 shows a third embodiment of a pump unit as in FIG. 3, wherein the field coils of the electric motor are axially arranged with respect to the magnets.

According to an aspect of the present invention, an improvement is provided by incorporating the electric motor 3 with the piston pump 4. Particularly, by incorporating a motor rotor 31 of the electric motor 3 with a pump rotor 46 of the piston pump 4 into a common rotor 6 as shown in FIG. 3-5. The common rotor 6 is a one piece item. The common rotor 6 is a separately mountable component of an assembled pump unit 26. The common rotor 6 is mountable as a whole to remaining parts of the pump unit 26.

The common rotor 6 is positioned inside the pump chamber 264. The common rotor 6 defines an axial axis A. The axial axis A is an axis of rotation of the common rotor 6. The common rotor 6 includes a motor rotor portion 61 which serves as a motor rotor 31 and a pump rotor portion 62 which serves as a pump rotor 46.

The electric motor 3 is a brushless DC motor. The DC motor is advantageous, because of its relatively long lifetime without intervening servicing. The electric motor 3 has a motor rotor 31 which forms the motor portion 61 of the common rotor 6. The motor rotor 31 has a motor rotor body 610. The motor rotor body 610 is cylindrically shaped and elongated. The motor rotor body 610 has an outer circumferential surface 611 and a motor rotor end face 612.

Further, the electric motor 3 comprises several field coils 32. The field coils 32 are DC field coils which in operation generate a magnetic field. The field coils 32 are positioned opposite the magnets 33 at the motor rotor body 610. Several embodiments including a rotor with magnets and opposite positioned field coils are possible and further illustrated in FIGS. 3-5.

According to an aspect of the invention, the motor rotor 31 and the pump rotor 46 are both supported by the pump stator 42. In contrast to conventional motors, the electric motor 3 according to the invention has no separate component serving as motor stator. The electric motor 3 has a motor rotor 31 which is supported by the pump stator 42 which makes a motor stator redundant.

The piston pump 4 is a rotary piston pump. Such a type of a piston pump is well known in the art. Such a rotary piston pump 40 includes pistons 41 which in operation rotate together with a pump rotor.

Such a rotary piston pump 40 has a pump rotor 46 and a pump stator 42. The pump stator 42 has an elongated stator body 420 which extends in an axial direction. The pump stator body 420 is beam shaped. The pump stator body 420 is stationarily fixed to the pump housing 261. The pump stator body 420 is fixed as a cantilever. The pump stator body 420 has a proximal stator end 421 which is fixed to the bottom surface 2641 of the pump chamber 264. The pump stator body 420 extends along the axial axis of the pump unit 26. The pump stator body 420 has a free distal stator end 422 which is positioned in the inner space provided by the pump chamber 264. The pump stator body 420 includes at least two channels forming at least one inlet channel 43 and at least one outlet channel 44 for transferring hydraulic liquid.

The pump rotor 46 has a pump rotor body 460 which is rotationally connected to the pump stator body 420 of the pump stator 42. The pump rotor body 460 is co-axially positioned with respect to the pump stator 42. The pump stator 42 supports the pump rotor 46. The pump rotor 46 is supported from one side. The pump stator 42 provides a single sided support to the pump rotor 46 as the pump stator 42 is only fixed at the proximal stator end 421 to the pump housing.

The pump rotor body 460 comprises several cylinder holes for each receiving a piston 41. The piston 41 has a longitudinal piston body 410. The piston body 410 has a proximal piston end which is directed to stator body 420 and a distal piston end which is directed radially outwards to a ring-shaped element which surrounds the rotor body 460. The ring-shaped element is a so-called eccentric ring 48. The rotor body 460 is positioned inside the eccentric ring 48.

To reduce wear, the eccentric ring 48 is formed as a bearing. The bearing may be a plain bearing. Here, the eccentric ring 48 is formed by a ball bearing having an inner ring and an outer ring, wherein the inner ring is beared by ball bearings with respect to the outer ring. The outer ring is stationarily positioned and fixed to the pump housing 261 and the inner ring is rotatably positioned. The inner ring of the eccentric ring 48 is movable in rotation together with the inside positioned pump rotor 46.

The eccentric ring 48 comprises an inner bearing surface which serves as a running surface 481 for the distal ends of the pistons 41. The running surface 481 is positioned opposite an outer circumferential rotor surface 621 of the pump rotor body 460. The eccentric ring 48 is eccentrically positioned with respect to the pump rotor body 460. A ring-shaped intermediate space in between the outer circumferential rotor surface 461 and the inner running surface 481 is provided to allow in operation the pistons 41 held by the pump rotor body 460 to move in a radial direction. Due to a present eccentricity E, a height of the intermediate space in between the outer circumferential rotor surface 621 and the running surface 481 is varying which will cause the pistons 41 to move in the radial direction when rotationally driving the pump rotor body 460. Radially inward moving pistons 41 will provide a pressure to the hydraulic liquid and will push hydraulic liquid through the outlet channel 44 and radially outward moving pistons 41 will provide an underpressure to the hydraulic liquid which will suck hydraulic liquid through the inlet channel 43. Herewith, the radially moving pistons 41 generate a pumping force working to power the hydraulic circuit.

FIG. 3-5 show schematic sectional views about a longitudinal axis of several embodiments of a pump unit in which several aspects of the invention are shown.

According to an aspect of the invention, the reservoir 263 is formed by the pump chamber 264. An inlet channel 43 of the pump stator 42 is in fluid communication with the pump chamber, such that hydraulic liquid can be transferred from the pump chamber 264 as a reservoir 263.

FIG. 3-5 schematically show three alternative embodiments of such improved pump units 26 including a common rotor 6 supported by only one individual stator. The shown embodiments include the same or similar components, but these components are spatially differently positioned.

The pump unit 26 comprises a pump housing 261 including a pump chamber 264 for housing the electric motor 3 and the piston pump 4 and a closure 265 to close the pump chamber 264. In FIGS. 3 and 4, the electric motor 3 and piston pump for are fully received in the pump chamber 264. In FIG. 5, a part of the electric motor 3 is positioned outside the pump chamber 264.

The pump housing 261 has a compact configuration. Here, the pump housing 261 is cylindrically shaped. The pump housing 261 has at least one external mounting face at an outer surface for mounting e.g. a valve unit 28, a control unit 29, an electrical supply and/or a reservoir 263.

The pump chamber 264 inside the pump housing 261 defines the axial axis A which extends from a front side F to a backside B of the pump housing. The pump chamber 264 is open at the front side F of the pump housing 261. The pump chamber 264 is formed by an inner space which is cylindrically shaped. The pump chamber 264 has a bottom surface 2641 and an inner circumferential surface 2642. The pump chamber 264 is adapted for at least partially receiving both the electric motor 3 and the piston pump 4.

The closure 265 is provided for closing the pump chamber 264 in an assembled configuration of the pump unit 26. The closure 265 is plate shaped. Here, the closure 265 is a lid which fits to the pump chamber opening. The closure 265 is sealably connectable to the pump housing 261 for hydraulically sealing the pump chamber 264.

Further, the pump unit 26 comprises a control unit 29. The control unit 29 has a compact configuration. The control unit 29 includes a printed circuit board PCB which is designed for controlling the pump unit 26. A functional scheme of controllable movements of a particular hydraulic actuating system 21, which is in particular a convertible roof system 2, is embedded in the design of the printed circuit board of the control unit 29. The control unit 29 is plate shaped and connectable to an external surface of the closure 265. The control unit 29 is adapted to the closure 265 from a module of the pump unit 26. The control unit 29 is sized in correspondence with the diameter of the closure 265. According to an aspect of the invention, the control unit 29 and the closure 265 form a subassembly. The subassembly of the control unit 29 and the closure 265 form the separate mountable module of the pump unit 26.

As shown in FIG. 3, the motor rotor body 610 comprises several magnets 33 which are positioned at the outer circumferential rotor surface 621. Field coils 32 are positioned opposite the magnets 33. The field coils 32 are radially positioned with respect to the magnets 33. The field coils 32 are positioned around the motor rotor 31. The field coils 32 are radially outwardly spaced from the magnets 33 which are supported by the motor rotor body 610. The field coils 32 are positioned inside the pump chamber 264 at the inner circumferential surface 2642.

FIG. 3 shows the pump stator 42 which extends through the rotor 6. Here, the pump stator 42 extends substantially until the motor rotor end face 612 of the rotor 6.

FIG. 4 shows a different spatial arrangement of the field coils 32 and the magnets 33. The field coils 32 are radially positioned with respect to the magnets 33. The motor rotor 31 comprises a rotor recess 613. The rotor recess 613 is open at the motor rotor end face 612 of the motor rotor portion 61. The rotor recess 613 is configured for receiving the field coils 32. The field coils 32 for generating a magnetic field are positioned opposite the magnets 33.

The magnets 33 are positioned at an inner surface, in particular an inner bottom or circumferential surface, of the rotor recess 613. Here, the magnets 33 are positioned at the inner circumferential surface of the rotor recess 613.

The field coils 32 are positioned inside the rotor recess 613. The field coils 32 are radially inwardly positioned with respect to the magnets 33 which are here positioned at the inner circumferential surface of the rotor recess 613. The field coils 32 are positioned inside the pump chamber 264.

The field coils 32 are connected to the closure 265. The field coils 32 are centrally positioned and connected to an inner surface of the closure 265.

FIG. 4 shows the pump stator 42 which extends through the rotor 6. Here, the pump stator 42 extends substantially until the bottom surface of the rotor recess 613. The pump stator 42 extends about at least half a length of the common rotor 6.

FIG. 5 shows a further different spatial arrangement of the field coils 32 and the magnets 33. The magnets 33 are positioned at the motor rotor end face 612 of the rotor 6. Field coils 32 are positioned opposite the magnets 33. The field coils 32 are located outside the pump chamber 264. The field coils 32 are connected to be closure 265 which covers the pump chamber 264. The closure 265 is positioned in between the field coils 32 and the magnets 33 on the rotor 6. The control unit 29 is connected via the field coils to the closure 265. Advantageously, in comparison with the radially arranged field coils and magnets as shown in FIGS. 3 and 4, the rotor 6 of the pump unit 26 in FIG. 5 including the axial arranged field coils and magnets has a very compact configuration.

FIG. 5 shows the pump stator 42 which extends through the rotor 6. Here the pump stator 42 extends until the motor rotor end face 612 of the rotor 6.

Besides the illustrated embodiments of the pump unit according to the invention, several variants are possible without departing from the scope.

Thus, the invention provides several aspects which allow a compact configuration of a pump unit. Such a compact pump unit is especially advantageous to be installed in a hydraulic actuating system for an automotive appliance, like a convertible roof system, in which the pump unit has to be build-in into narrow chassis compartments.

The above-mentioned aspects of the invention are to be considered independent from each other. In particular, the aspect regarding the arrangement of the field coils and magnets is considered to be technically independent from the aspect of the one piece common rotor supported by the pump stator only and from the aspect of the pump chamber which houses the piston pump and electric motor and which pump chamber serves as a reservoir of the pump unit.

Particular embodiments according to the invention are defined in the following clauses:

1. Pump unit (26) for pressurising a hydraulic actuating system (21), in particular for pressurising an automotive actuating system, like a convertible roof system (2), boot lid, hood cover system or wheel suspension of a vehicle (1), wherein the pump unit comprises a pump housing (261) including a pump chamber (264) for housing a piston pump (4) and wherein the pump unit (26) further comprises an electric motor (3) for driving the piston pump wherein the electric motor (3) comprises:

a motor rotor (31), wherein the motor rotor comprises a longitudinal motor rotor body (610) including several magnets (33) at an outer surface, wherein the motor rotor body (610) defines an axial axis;

a field coil (32) which is positioned opposite the magnets of the motor rotor body (610) for rotationally driving the motor rotor body (610);

wherein the piston pump (4) comprises:

a pump stator (42) which is stationarily positioned inside the pump chamber (264), which pump stator has a longitudinal stator body (420), in which the pump stator body (420) includes at least two channels serving respectively as an inlet or outlet channel (43, 44);

a pump rotor (46) positioned around the pump stator body (420), which pump rotor has a pump rotor body (620) which is driveable in a rotational direction about the axial axis, wherein the pump rotor body (620) includes several cylinder holes for each receiving a piston (41) which is slidable with respect to the pump rotor body (620) in a radial direction;

an eccentric ring (48) positioned around the pump rotor body (620), in which the eccentric ring (48) is eccentrically positioned at an eccentricity E with respect to the pump rotor body (620) to provide a pump capacity;

wherein the motor rotor (31) and the pump rotor (46) are incorporated into a common rotor (6) which is a one piece item including a motor and a pump rotor portion (61,62) and wherein the common rotor (6) is only supported by the pump stator (42).

2. Pump unit (26) for pressurising a hydraulic actuating system (21), in particular for pressurising an automotive actuating system, like a convertible roof system (2), boot lid, hood cover system or wheel suspension of a vehicle (1), wherein the pump unit comprises a pump housing (261) including a pump chamber (264) for housing a piston pump (4) and wherein the pump unit (26) further comprises an electric motor (3) for driving the piston pump wherein the electric motor (3) comprises:

a motor rotor (31), wherein the motor rotor comprises a longitudinal motor rotor body (610) including several magnets (33) at an outer surface, wherein the motor rotor body (610) defines an axial axis;

a field coil (32) which is positioned opposite the magnets of the motor rotor body (610) for rotationally driving the motor rotor body (610);

wherein the piston pump (4) comprises:

a pump stator (42) which is stationarily positioned inside the pump chamber (264), which pump stator has a longitudinal stator body (420), in which the pump stator body (420) includes at least two channels serving respectively as an inlet or outlet channel (43, 44);

a pump rotor (46) positioned around the pump stator body (420), which pump rotor has a pump rotor body (620) which is driveable in a rotational direction about the axial axis, wherein the pump rotor body (620) includes several cylinder holes for each receiving a piston (41) which is slidable with respect to the pump rotor body (620) in a radial direction;

an eccentric ring (48) positioned around the pump rotor body (620), in which the eccentric ring (48) is eccentrically positioned at an eccentricity E with respect to the pump rotor body (620) to provide a pump capacity;

wherein the motor rotor (31) and the pump rotor (46) are incorporated into a common rotor (6) which is a one piece item including a motor and a pump rotor portion (61,62) and, wherein the magnets (33) of the motor rotor (31) are positioned at an outer circumferential motor rotor surface (611).

3. Pump unit (26) for pressurising a hydraulic actuating system (21), in particular for pressurising an automotive actuating system, like a convertible roof system (2), boot lid, hood cover system or wheel suspension of a vehicle (1), wherein the pump unit comprises a pump housing (261) including a pump chamber (264) for housing a piston pump (4) and wherein the pump unit (26) further comprises an electric motor (3) for driving the piston pump wherein the electric motor (3) comprises:

a motor rotor (31), wherein the motor rotor comprises a longitudinal motor rotor body (610) including several magnets (33) at an outer surface, wherein the motor rotor body (610) defines an axial axis;

a field coil (32) which is positioned opposite the magnets of the motor rotor body (610) for rotationally driving the motor rotor body (610);

wherein the piston pump (4) comprises:

a pump stator (42) which is stationarily positioned inside the pump chamber (264), which pump stator has a longitudinal stator body (420), in which the pump stator body (420) includes at least two channels serving respectively as an inlet or outlet channel (43, 44);

a pump rotor (46) positioned around the pump stator body (420), which pump rotor has a pump rotor body (620) which is driveable in a rotational direction about the axial axis, wherein the pump rotor body (620) includes several cylinder holes for each receiving a piston (41) which is slidable with respect to the pump rotor body (620) in a radial direction;

an eccentric ring (48) positioned around the pump rotor body (620), in which the eccentric ring (48) is eccentrically positioned at an eccentricity E with respect to the pump rotor body (620) to provide a pump capacity;

wherein the motor rotor (31) and the pump rotor (46) are incorporated into a common rotor (6) which is a one piece item including a motor and a pump rotor portion (61, 62) and wherein the common rotor (6) has a motor rotor recess (613) which is open at a motor rotor end face (612), wherein the motor rotor recess (613) has an inner circumferential surface (614) and an inner bottom surface (615), wherein the magnets are positioned at the inner circumferential or bottom surface.

4. Pump unit (26) for pressurising a hydraulic actuating system (21), in particular for pressurising an automotive actuating system, like a convertible roof system (2), boot lid, hood cover system or wheel suspension of a vehicle (1), wherein the pump unit comprises a pump housing (261) including a pump chamber (264) for housing a piston pump (4) and wherein the pump unit (26) further comprises an electric motor (3) for driving the piston pump wherein the electric motor (3) comprises:

a motor rotor (31), wherein the motor rotor comprises a longitudinal motor rotor body (610) including several magnets (33) at an outer surface, wherein the motor rotor body (610) defines an axial axis;

a field coil (32) which is positioned opposite the magnets of the motor rotor body (610) for rotationally driving the motor rotor body (610);

wherein the piston pump (4) comprises:

a pump stator (42) which is stationarily positioned inside the pump chamber (264), which pump stator has a longitudinal stator body (420), in which the pump stator body (420) includes at least two channels serving respectively as an inlet or outlet channel (43, 44);

a pump rotor (46) positioned around the pump stator body (420), which pump rotor has a pump rotor body (620) which is driveable in a rotational direction about the axial axis, wherein the pump rotor body (620) includes several cylinder holes for each receiving a piston (41) which is slidable with respect to the pump rotor body (620) in a radial direction;

an eccentric ring (48) positioned around the pump rotor body (620), in which the eccentric ring (48) is eccentrically positioned at an eccentricity E with respect to the pump rotor body (620) to provide a pump capacity;

wherein the motor rotor (31) and the pump rotor (46) are incorporated into a common rotor (6) which is a one piece item including a motor and a pump rotor portion (61,62) and wherein the magnets (33) of the motor rotor (31) are positioned at the motor rotor end face (612) of the common rotor (6).

5. Pump unit (26) for pressurising a hydraulic actuating system (21), in particular for pressurising an automotive actuating system, like a convertible roof system (2), boot lid, hood cover system or wheel suspension of a vehicle (1), wherein the pump unit comprises a pump housing (261) including a pump chamber (264) for housing a piston pump (4) and wherein the pump unit (26) further comprises an electric motor (3) for driving the piston pump wherein the electric motor (3) comprises:

a motor rotor (31), wherein the motor rotor comprises a longitudinal motor rotor body (610) including several magnets (33) at an outer surface, wherein the motor rotor body (610) defines an axial axis;

a field coil (32) which is positioned opposite the magnets of the motor rotor body (610) for rotationally driving the motor rotor body (610);

wherein the piston pump (4) comprises:

a pump stator (42) which is stationarily positioned inside the pump chamber (264), which pump stator has a longitudinal stator body (420), in which the pump stator body (420) includes at least two channels serving respectively as an inlet or outlet channel (43, 44);

a pump rotor (46) positioned around the pump stator body (420), which pump rotor has a pump rotor body (620) which is driveable in a rotational direction about the axial axis, wherein the pump rotor body (620) includes several cylinder holes for each receiving a piston (41) which is slidable with respect to the pump rotor body (620) in a radial direction;

an eccentric ring (48) positioned around the pump rotor body (620), in which the eccentric ring (48) is eccentrically positioned at an eccentricity E with respect to the pump rotor body (620) to provide a pump capacity;

wherein the motor rotor (31) and the pump rotor (46) are incorporated into a common rotor (6) which is a one piece item including a motor and a pump rotor portion (61,62) and wherein the pump unit (26) further comprises a control unit (29) for controlling the pump capacity, wherein the control unit (29) is connectable to a closure (265) of the pump housing (261) for closing a pump chamber (264), wherein the control unit (29) and the closure (265) form a subassembly which is mountable as a module to the pump housing.

6. Pump unit (26) for pressurising a hydraulic actuating system (21), in particular for pressurising an automotive actuating system, like a convertible roof system (2), boot lid, hood cover system or wheel suspension of a vehicle (1), wherein the pump unit comprises a pump housing (261) including a pump chamber (264) for housing a piston pump (4) and wherein the pump unit (26) further comprises an electric motor (3) for driving the piston pump wherein the electric motor (3) comprises:

a motor rotor (31), wherein the motor rotor comprises a longitudinal motor rotor body (610) including several magnets (33) at an outer surface, wherein the motor rotor body (610) defines an axial axis;

a field coil (32) which is positioned opposite the magnets of the motor rotor body (610) for rotationally driving the motor rotor body (610);

wherein the piston pump (4) comprises:

a pump stator (42) which is stationarily positioned inside the pump chamber (264), which pump stator has a longitudinal stator body (420), in which the pump stator body (420) includes at least two channels serving respectively as an inlet or outlet channel (43, 44);

a pump rotor (46) positioned around the pump stator body (420), which pump rotor has a pump rotor body (620) which is driveable in a rotational direction about the axial axis, wherein the pump rotor body (620) includes several cylinder holes for each receiving a piston (41) which is slidable with respect to the pump rotor body (620) in a radial direction;

an eccentric ring (48) positioned around the pump rotor body (620), in which the eccentric ring (48) is eccentrically positioned at an eccentricity E with respect to the pump rotor body (620) to provide a pump capacity;

wherein the motor rotor (31) and the pump rotor (46) are incorporated into a common rotor (6) which is a one piece item including a motor and a pump rotor portion (61,62) and wherein the reservoir (263) is formed by the pump chamber in the pump housing.

Thus, an automotive hydraulic actuating system is provided for actuating a movable vehicle part, like a roof part or a wheel suspension. The actuating system comprises a pump unit. The pump unit comprises a piston pump which has a pump rotor and an electric motor which has a motor rotor. The pump rotor and motor rotor are incorporated into a single common rotor. The rotor is a one piece item. The rotor is positioned inside a pump chamber around a pump stator of the piston pump. The pump stator provides a full support to the common rotor. Advantageously, without a separate motor stator, the pump unit has a more compact configuration. Additionally, the pump unit has an improved dynamic performance which contributes to a silent and reliable operation at a high rotational speed.

LEGEND TO THE FIGURES

1 vehicle
11 front window frame
12 locking member
2 convertible roof system
20 convertible roof
200 roof part
201 remaining roof part
202 cover plate
21 hydraulic actuating system
23, 23' hydraulic cylinder
24, 24' hydraulic cylinder
25 hydraulic cylinder
22 hydraulic cylinder
26 pump unit
261 pump housing
263 reservoir
264 pump chamber
2641 bottom surface
2642 circumferential surface
265 closure
28 valve unit
29 control unit
3 electric motor
31 motor rotor
32 field coil
33 magnet
4 piston pump
40 rotary piston pump
41 piston
410 piston body
42 pump stator
420 pump stator body
421 pump stator proximal end
422 pump stator distal end
43 inlet channel
44 outlet channel
46 pump rotor
48 eccentric ring
481 running surface
482 outer circumferential ring surface
484 motor end face
49 link
E eccentricity
5 ring actuator
53 lever
6 common rotor
61 motor rotor portion
610 motor rotor body
611 motor rotor outer circumferential surface
612 motor rotor end face
613 motor rotor recess
614 motor rotor inner circumferential surface
615 motor rotor inner bottom surface
62 pump rotor portion
620 pump rotor body
621 outer circumferential rotor surface
622 pump rotor end face

The invention claimed is:

1. A pump unit for pressurising a hydraulic actuating system, wherein the pump unit comprises a pump housing including a pump chamber for housing a piston pump, and wherein the pump unit further comprises an electric motor for driving the piston pump, wherein the electric motor comprises:

a motor rotor, wherein the motor rotor comprises a longitudinal motor rotor body including several magnets at an outer surface, wherein the motor rotor body defines an axial axis;

a field coil which is positioned opposite the magnets of the motor rotor body for rotationally driving the motor rotor body;

wherein the piston pump comprises:

a pump stator which is stationary inside the pump chamber, which pump stator has a longitudinal stator body which includes at least two channels serving respectively as an inlet or outlet channel;

a pump rotor positioned around the pump stator body, which pump rotor has a pump rotor body which is driveable in a rotational direction about the axial axis, wherein the pump rotor body includes several cylinder holes for each receiving a piston which is slidable with respect to the pump rotor body in a radial direction;

a ring positioned around the pump rotor body, wherein the ring is eccentrically positioned at an eccentricity with respect to the pump rotor body to provide a pump capacity;

wherein the motor rotor and the pump rotor are incorporated into a common rotor such that the motor rotor body and the pump rotor body are formed as a one piece item with the motor rotor and the pump rotor located on opposite axial ends and wherein the pump stator is fixed to the pump housing adjacent to the pump rotor as a cantilever which extends axially through the pump rotor body to a position beyond the cylinder holes such that the common rotor is fully supported by the cantilevered pump stator.

2. The pump unit according to claim 1, wherein the pump stator extends through the common rotor over at least half a length of the common rotor.

3. The pump unit according to claim 1, wherein the common rotor is manufactured from a solid part.

4. The pump unit according to claim 1, wherein the magnets of the motor rotor are positioned at an outer circumferential motor rotor surface.

5. The pump unit according to claim 1, wherein the common rotor has a motor rotor recess which is open at a motor rotor end face, wherein the motor rotor recess has an inner circumferential surface and an inner bottom surface, wherein the magnets are positioned at the inner circumferential surface or at the inner bottom surface.

6. The pump unit according to claim 1, wherein the magnets of the motor rotor are positioned at a motor rotor end face of the common rotor.

7. The pump unit according to claim 1, wherein the field coil is positioned outside the pump chamber of the pump housing.

8. The pump unit according to claim 1, wherein the pump unit further comprises a control unit for controlling the pump capacity, wherein the control unit is connectable to a closure of the pump housing for closing a pump chamber, wherein the control unit and the closure form a subassembly which is mountable as a module to the pump housing.

9. The pump unit according to claim 8, wherein the module of the control unit and closure further comprises at least one field coil of the electric motor.

10. The pump unit according to claim 1, wherein a reservoir is formed by the pump chamber in the pump housing.

11. The pump unit according to claim 1, wherein the pump stator extends into the motor rotor body to an axial position of the magnets.

* * * * *